US005080268A

United States Patent [19]

Rios

[11] Patent Number: 5,080,268

[45] Date of Patent: Jan. 14, 1992

[54] CLOTHES HANGER WITH REMOVABLE GARMENT RETAINER IN FRAME

[76] Inventor: Enrique Rios, 103 Upland Ter., Collingdale, Pa. 19023

[21] Appl. No.: 692,703

[22] Filed: Apr. 29, 1991

[51] Int. Cl.[5] ..... A47G 25/48; A47G 25/16

[52] U.S. Cl. ..... 223/96; 223/95; 223/93; 223/91; 223/90; D6/328

[58] Field of Search ..... 223/85, 86, 90, 92, 223/93, 95, 96; D6/328, 315, 318; 211/113

[56] References Cited

U.S. PATENT DOCUMENTS

| | | | |
|---|---|---|---|
| 966,854 | 8/1910 | Peyton | 223/96 |
| 2,008,604 | 7/1935 | Troutman et al. | 223/93 |
| 3,115,286 | 12/1963 | Bassin | 223/96 |
| 3,229,871 | 1/1966 | Capo | 223/96 X |
| 3,411,680 | 11/1968 | Lundeen | 223/96 |
| 3,897,893 | 8/1975 | Lemmenes | 223/96 X |
| 4,768,686 | 9/1988 | Storti | 223/92 X |
| 5,040,707 | 8/1991 | Ayaro et al. | 223/96 |

FOREIGN PATENT DOCUMENTS

| | | | |
|---|---|---|---|
| 1067465 | 12/1979 | Canada | 223/96 |
| 1429934 | 1/1969 | Fed. Rep. of Germany | 223/93 |
| 1299029 | 12/1972 | United Kingdom | 223/93 |

*Primary Examiner*—Werner H. Schroeder
*Assistant Examiner*—Bibhu Mohanty
*Attorney, Agent, or Firm*—Anthony F. Cuoco

[57] ABSTRACT

A garment retainer includes a saddle member having an open channel which is disposed over a garment folded over the crossbar of a conventional clothes hanger. At least two resilient members have portions which span the open channel and which are urged into said channel by the crossbar when a downward pressure is exerted on the retainer via the compression of a pair of flexible strips which are part of the retainer and which engage a portion of the hanger above the crossbar, whereby a pressure is exerted on the garment so that said garment is retained on the hanger without sliding or wrinkling thereon.

16 Claims, 1 Drawing Sheet

CLOTHES HANGER WITH REMOVABLE GARMENT RETAINER IN FRAME

BACKGROUND OF THE INVENTION

Conventional clothes hangers made of plastic, wood or bent metal or plastic wire usually feature a lower crossbar and a member at each of the opposite ends of the crossbar which extends upwardly so that said upwardly extending members terminate in a vertex, whereby a frame-like hanger structure is provided. A hook extends upwardly from the vertex to support the frame-like hanger structure on a supporting member, such as a bar, rack, hook or the like.

Garments, such as slacks or skirts, are folded over the hanger crossbar. A problem exists in that garments so folded slide from one side of the crossbar toward the other; wrinkle on the crossbar; or fall from the hanger completely.

Various arrangements have been used to alleviate this problem. For example, the crossbars may have a gripping surface which tends to retain the folded garment in place. A paper overlay having a sticky or friction surface has been disposed on the crossbars to retain the folded garments thereon. A clamping bar has been attached to one end of the hanger crossbar and is engaged at the opposite end to clamp the folded garment on the crossbar. None of these arrangements has been particularly satisfactory for the purposes desired.

The present invention features a garment retainer which is inserted within the frame structure of a conventional clothes hanger in cooperative arrangement with the hanger crossbar and vertex for accomplishing the purposes desired.

SUMMARY OF THE INVENTION

This invention contemplates, in combination with a conventional clothes hanger of the type including a lower crossbar and members extending from opposite ends of the crossbar and terminating in a vertex for forming a hanger frame, a garment retainer disposed within the hanger frame in cooperative relation with the vertex and crossbar for retaining a garment on the hanger which is folded over the crossbar.

The garment retainer includes a saddle member having a downwardly extending open channel. The saddle member is disposed within the hanger frame so that the open channel is above the crossbar and the crossbar recedes into the open channel against portions of at least two resilient members mounted to the saddle member, and which resilient member portions transversely span the open channel with a moderate tension.

A pair of flexible members extend upwardly from the saddle member and terminate in a notched plate which engages the hanger vertex. The flexible members are compressed between the notched plate and the saddle member, whereby a moderate pressure is exerted on the folded garment by the resilient members as the channel spanning portions of said members are urged into the open channel by the receding crossbar, whereby the garment is retained on said crossbar.

DETAILED DESCRIPTION OF THE INVENTION

Figure 1:
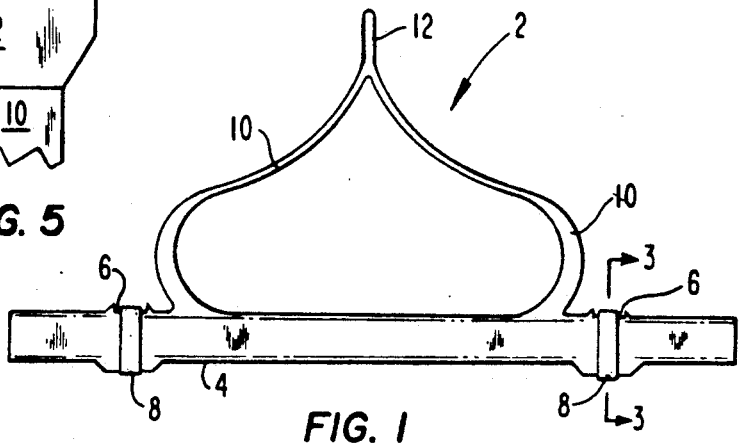
FIG. 1 is a diagrammatic front elevational view showing a garment retainer according to the invention.

With reference first to FIG. 1, a garment retainer is designated generally by the numeral 2. Garment retainer 2 includes a saddle member 4. Saddle member 4 has at least two grooves 6 near its opposite ends thereof and extending therearound. Additional grooves may be provided along the length of saddle member 4 as may be required for the purposes intended.

Figure 3:
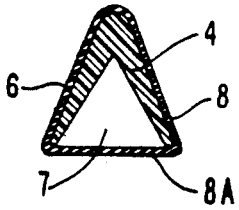
FIG. 3 is a sectional view taken along the line 3—3 in FIG. 1.
Figure 6:
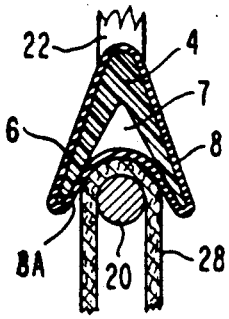
FIG. 6 is a fragmentary sectional view taken along line 6—6 in FIG. 2.

Saddle member 4 has an open channel 7 which may be generally V-shaped in cross-section as shown in FIGS. 3 and 6. It will be recognized, however, that the cross-sectional shape of channel 7 may be circular or oval, or any other shape compatible with the cross-sectional shape of a crossbar of a hanger with which retainer 2 is to be used, as will be hereinafter readily discerned.

A resilient member 8 is disposed in each of the grooves 6. While resilient members 8 may take a variety of forms, in the preferred embodiment of the invention, they are continuous rubber bands or the like which fit into the grooves and have portions 8A which span the open channel with a moderate tension as particularly shown in FIG. 3.

Figure 2:
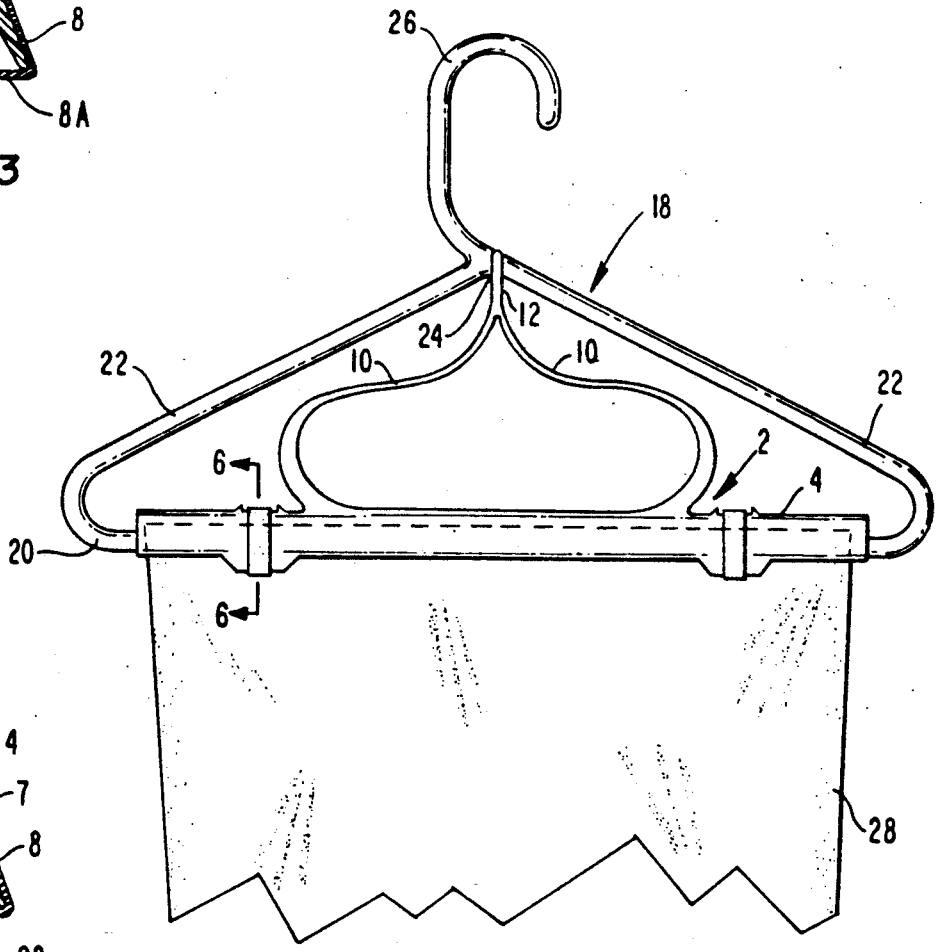
FIG. 2 is a diagrammatic front elevational view showing the garment holder of FIG. 1 in combination with a conventional clothes hanger, whereby a garment, which is folded over the hanger crossbar, is retained thereon.

A pair of flexible strips 10 extend upwardly from near each of the opposite ends of saddle member 4 and terminate in a plate 12 as shown in FIGS. 1 and 2. Flexible strips 10 are shown as extending symmetrically so that plate 12 is substantially centrally disposed relative to saddle member 4, but this need not necessarily be the case, as will be hereinafter understood.

Figure 4:
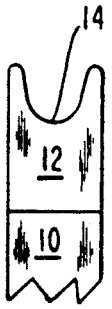
FIG. 4 is a fragmentary diagrammatic end elevational view showing one form of a notched plate which is part of the garment retainer shown in FIGS. 1 and 2 and which engages the hanger vertex.
Figure 5:
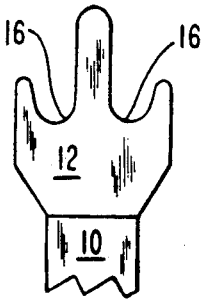
FIG. 5 is a fragmentary diagrammatic end elevational view showing another form of the notched plate.

Plate 12 is arranged to engage the aforementioned conventional coat hanger in a manner as will be hereinafter explained and for this purpose plate 12 includes a notched upper end. One form of plate 12 is shown in FIGS. 1, 2 and 4 wherein the upper end of the plate includes a symmetrically disposed notch 14. Another form of plate 12 is shown in FIG. 5, wherein a pair of notches 16 on opposite sides of the plate are provided for the purposes intended.

In regard to garment retainer 2, in the preferred embodiment of the invention the garment retainer is an integral member molded or otherwise fabricated of a suitable plastic material so as to best serve the purposes of the invention.

With particular reference to FIG. 2, a conventional clothes hanger is designated by the numeral 18. Clothes hanger 18 includes a lower crossbar 20 and a pair of members 22 extending generally angularly upwardly from the opposite ends of crossbar 20 so as to terminate in a vertex 24, wherein a frame-like structure is provided. A hook or the like 26 extends upwardly from the frame-like structure, whereby the clothes hanger may be supported on a rod, a rack, a hook or some other such supporting member not otherwise shown.

It is often desireable to fold a garment 28 such as slacks or a skirt over crossbar 20 as particularly shown in the Figures. With clothes hangers heretofore known, a problem is presented in that the folded garment wrinkles, slides or otherwise falls away from the clothes hanger. The garment retainer in accordance with the present invention is intended to alleviate this problem.

Thus, and with reference to FIGS. 2 and 6, with garment 28 folded over crossbar 20, retainer 2 is disposed within the frame-like structure of hanger 18. That is to say, saddle member 4 is mounted with open channel 7 disposed over garment 28 as will be discerned from the Figures. Downward pressure is manually applied by a user to flexible strips 10 of retainer 2, whereby the strips flex so that the upper portion of retainer 2 is lowered. The aforenoted downward pressure is applied until notch 14 or notches 16 in plate 12 of retainer 2, as the case may be, engage vertex 24. This requires a slight rotation of plate 12 of garment retainer 2, as will now be understood.

Under the pressure of flexible strips 10 provided as aforenoted, hanger crossbar 20 recedes into channel 7 of saddle member 2 against the moderate tension of channel spanning portions 8A of resilient members 8, and thereupon urges the channel spanning portions into channel 7, as best shown in FIG. 6. Thus, a moderate pressure is exerted on garment 28 to avoid any sliding, pinching, wrinkling or displacement of the garment from hanger crossbar 20 as is desired.

There has thus been disclosed a garment retainer used in combination with a conventional clothes hanger wherein garments folded over the crossbar of the clothes hanger are prevented from falling off the clothes hanger or from sliding to either side of the crossbar thereof. A saddle member has at least two resilient members having portions spanning an open channel thereof with a moderate tension. The resilient member portions are urged into the channel by the hanger crossbar whereupon the garment retainer exerts a moderate pressure on the garment when a plate member thereof engages the vertex of the clothes hanger, whereby the garment is retained on the crossbar.

Although in the preferred embodiment of the invention the retainer engages the vertex of the clothes hanger, any other part of the clothes hanger above the crossbar can be so engaged as long as the flexible strips which are part of the retainer apply a downward pressure on the saddle bar to retain the garment on the crossbar of the hanger via resilient members 8 as aforenoted.

With the above description of the invention in mind, reference is made to the claims appended hereto for a detailed description of the invention.

I claim:

1. In combination with a clothes hanger of the type including a frame having a lower crossbar, a garment retainer disposed within the frame for retaining a garment folded over the crossbar comprising:

a saddle member having an open channel disposed over the crossbar;

at least two resilient members supported on the saddle member in spaced relation and having portions transversely spanning the open channel with a moderate tension;

a pair of flexible members extending upwardly from the saddle member and terminating in a member which engages the hanger frame above the crossbar; and the flexible members being compressed between the member engaging the hanger above the crossbar and the saddle member, whereupon the hanger crossbar recedes into the open channel against the moderate tension of the channel spanning portions of the resilient members so that a moderate pressure is exerted on the garment to retain said garment folded on the hanger crossbar.

2. A combination as described by claim 1, wherein:

the clothes hanger frame includes a pair of members near opposite ends of the crossbar, said members extending upwardly therefrom and terminating at a vertex; and the member which engages the hanger frame above the crossbar engages the vertex.

3. A combination as described by claim 1, wherein:

the saddle member has at least two grooves disposed in spaced relation and extending therearound; and each of the at least two resilient members is supported in a corresponding groove.

4. A combination as described by claim 1, wherein:

the member which engages the hanger frame above the crossbar includes a plate having a notched upper end; and the notched upper end of the plate engages the hanger frame above the crossbar.

5. A combination as described by claim 4, wherein:

the notched upper end includes a single substantially symmetrically disposed notch for engaging the hanger frame above the crossbar.

6. A combination as described by claim 4, wherein:

the notched upper end includes a first notch at one side of the plate and a second notch at the opposite side of the plate; and one of the first and second notches engages the hanger frame above the crossbar.

7. A combination as described by claim 2, wherein:

the member which engages the hanger frame above the crossbar includes a plate having a notched upper end; and the notched upper end of the plate engages the vertex.

8. A combination as described by claim 7, wherein:

the notched upper end of the plate includes a single substantially centrally disposed notch for engaging the vertex.

9. A combination as described by claim 7, wherein:

the notched upper end of the plate includes a first notch at one side of the plate and a second notch at the opposite side of the plate; and one of the first and second notches engages the vertex.

10. A combination as described by claim 1, wherein:

the cross-sectional shape of the channel is compatible with the cross-sectional shape of the hanger crossbar.

11. In combination with a clothes hanger of the type including a frame having a lower crossbar and a vertex, a garment retainer disposed within the frame for retaining a garment folded over the crossbar comprising:

a saddle member having an open channel disposed over the crossbar, with the cross-sectional shape of the channel member being compatible with that of the crossbar;

at least two resilient members supported in grooves disposed in spaced relation on said saddle member and extending therearound, said resilient members having portions transversely spanning the open channel with a moderate tension;

a pair of flexible members extending upwardly from the channel member and terminating in a member which engages the hanger frame vertex; and the flexible members being compressed between the member which engages the hanger frame vertex and the saddle member, whereupon the hanger frame crossbar recedes into the open channel against the moderate tension of the channel spanning portions of the resilient members so that a moderate pressure is exerted on the garment to retain said garment folded on the hanger crossbar.

12. A combination as described by claim 11, wherein:

the member which engages the hanger frame vertex has a notched upper end; and the notched upper end engages the hanger frame vertex.

13. A combination as described by claim 12, wherein:

the notched upper end includes a single substantially symmetrically disposed notch which engages the vertex.

14. A combination as described by claim 12, wherein:

the notched upper end includes a first notch on one side thereof and a second notch on the opposite side thereof; and one of the first and second notches engages the vertex.

15. A combination as described by claim 2, wherein:

the pair of members near opposite ends of the crossbar extending upwardly therefrom extend substantially symmetrically so as to terminate at the vertex which is disposed substantially central to the crossbar; and the pair of flexible members extending upwardly from the saddle member extend substantially symmetrically so as to terminate at the hanger frame engaging member which is substantially central to the channel member and to the crossbar.

16. A combination as described by claim 11, wherein:

the vertex is substantially central to the crossbar; and the pair of flexible members extending upwardly from the saddle member extend substantially symmetrically so as to terminate at the hanger frame vertex engaging member which is substantially central to the channel member and to the crossbar.

* * * * *